United States Patent [19]

Dexter et al.

[11] Patent Number: 4,900,371

[45] Date of Patent: Feb. 13, 1990

[54] METHOD AND APPARATUS FOR THERMOCHEMICAL TREATMENT

[75] Inventors: Amos C. Dexter, Liverpool; Michael I. Lees, Tarvin; Barry J. Taylor, Mold, all of United Kingdom

[73] Assignee: The Electricity Council, United Kingdom

[21] Appl. No.: 109,078

[22] Filed: Oct. 16, 1987

[30] Foreign Application Priority Data

Oct. 29, 1986 [GB] United Kingdom ..... 8625912

[51] Int. Cl.[4] ..... C21D 1/06

[52] U.S. Cl. ..... 148/20.3; 148/16.5; 204/164; 266/251

[58] Field of Search ..... 148/16, 16.5, 16.6, 148/20.3, 316, 317, 318, 319; 204/164; 266/251, 252, 258

[56] References Cited

U.S. PATENT DOCUMENTS

| | | | |
|---|---|---|---|
| 3,228,809 | 1/1966 | Berghaus et al. | 148/16.6 |
| 4,181,541 | 1/1980 | LeFrancois | 148/16.6 |
| 4,490,190 | 12/1984 | Speri | 148/16.6 |
| 4,645,981 | 2/1987 | Stramke | 315/227 R |

FOREIGN PATENT DOCUMENTS

| | | |
|---|---|---|
| 601847 | 8/1934 | Fed. Rep. of Germany . |
| 744753 | 2/1956 | United Kingdom . |
| 759694 | 10/1956 | United Kingdom . |
| 810802 | 3/1959 | United Kingdom . |
| 901017 | 7/1962 | United Kingdom . |
| 960549 | 6/1964 | United Kingdom . |
| 1255321 | 12/1971 | United Kingdom . |
| 1349290 | 4/1974 | United Kingdom . |
| 1367687 | 9/1974 | United Kingdom . |
| 2030600 | 4/1980 | United Kingdom . |
| 2154754 | 9/1985 | United Kingdom . |
| 81/00930 | of 1981 | World Int. Prop. O. . |

OTHER PUBLICATIONS

Patent Abstracts of Japan, vol. 4, No. 65 (C-10) (547), May 16, 1980; JP-A-55 31 139 (Nippon Denshi Kogyo K.K.) 05-03-1980.

Harterei-Technische Mitteilungen, vol. 37, No. 6, Nov.-Dec. 1982, pp. 263-269, Carl Hanser Verlag, Munchen, DE; H. Wilhelmi et al.: "Nitrieren mit gepulster Glimmentladung."

ZWF Zwitschrift Fur Wirtschaftliche Fertigung, vol. 78, No. 12, Dec. 1983, pp. 541-592, Carl Hanser Verlag, Munchen, DE; S. Stramke et al.: "Eltropuls-Plasmanitrieren, ein neues Verfahren der Warmebehandlungstechnik."

*Primary Examiner*—Robert McDowell

*Attorney, Agent, or Firm*—Kinney & Lange

[57] ABSTRACT

Known techniques of plasma case hardening of workpieces may fail to provide sufficient treatment to reentrant portions, such as fine holes, in the workpiece. This specification discloses a technique of pulsed plasma treatment in which the duration of the plasma pulses and the intervals between them are selected to allow a substantially even distribution of the gas which forms the plasma over all the surface to be treated of the workpiece.

8 Claims, 1 Drawing Sheet

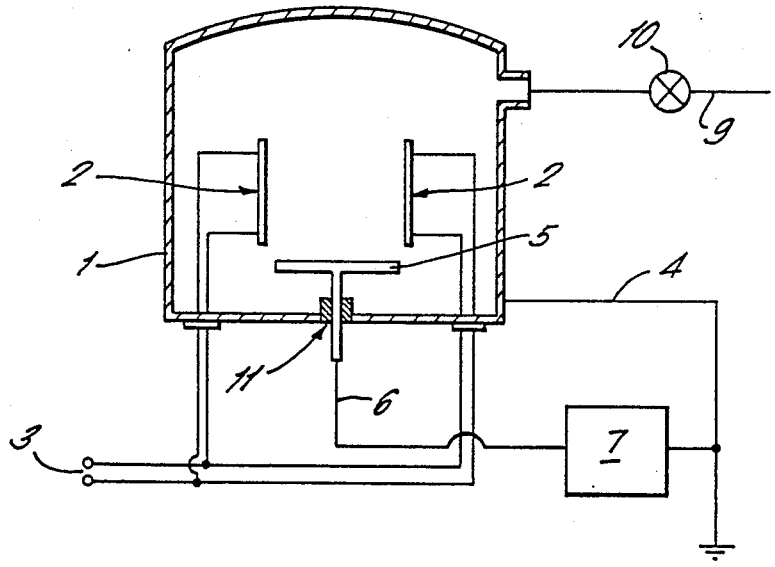
10
9
2
2
5
1
4
11
6
3
7

METHOD AND APPARATUS FOR THERMOCHEMICAL TREATMENT

FIELD OF THE INVENTION

This invention relates to a method and apparatus for thermochemical treatment, and in particular to a method and apparatus for thermochemical treatment relating to the case hardening of a workpiece.

DESCRIPTION OF THE PRIOR ART

A variety of case hardening materials are known. For instance, the surface to be treated may be carburised, nitrided, carbo-nitrided or nitro-carburised: this surface treatment may be essential in producing a workpiece having satisfactory mechanical properties. Similarly, a number of methods of applying the surface treatment are known. Commonly, plasma enhanced surface treatment is employed: the workpiece is immersed in a gaseous atmosphere comprising, for instance, nitrogen or ammonia for nitriding, or a hydrocarbon for carburising. The gaseous atmosphere is at a concentration and temperature such that the surface treatment reaction proceeds only extremely slowly. Enhancement of the reaction rate is, however, possible if the gaseous atmosphere comprises a plasma: ionic bombardment of the workpiece surface then occurs with the conversion of kinetic energy of incident ions from the plasma providing sufficient energy to allow the completion of the surface treatment reaction. Generally, the workpiece is independently heated, the entire process occuring in, for instance, an electric furnace: a predetermined treatment temperature, generally 550°-600° C. for nitriding and 850°-1050° C. for carburising is required to ensure the workpiece undergoes the phase transitions necessary for the required mechanical properties. Alternatively the bombarding ions may themselves be sufficiently energetic to raise the workpiece to the necessary temperature. Such a plasma is commonly described as being a "hot" plasma since a significant amount of thermal energy is transferred from the plasma to the workpiece.

Generally, plasma enhanced surface treatment relies upon a high voltage electircal discharge to generate the continuous plasma which envelops the workpiece. Usually, the workpiece may itself comprise the cathode to which a luminescent discharge is struck, the cathode and anode being connected to a high voltage D.C. power supply for supplying a continuous current. In addition to the very general use of a continuous plasma, it is known (see, for instance, U.S. Pat. No. 4,181,541) to pulse a "hot" plasma to reduce the heat supplied from the plasma to a level which is meant to merely maintain the workpiece at the necessary treatment temperature. Although the purpose of such a technique is to provide for the accurate maintenance and uniformity of the temperature of the workpiece, the later U.S. Pat. No. 4,490,190 concedes that the approach of U.S. Pat. No. 4,181,541 was not succesful in achieving this. Readdressing this requirement, U.S. Pat. No. 4,490,190 teaches the application of a series of discrete high voltage discharge pulses to generate a continuous "cold" plasma around the workpiece, the workpiece being independently heated.

It is a problem, however, with known arrangements that re-entrant portions of a workpiece, such as narrow recesses or fine holes, may obtain insufficient surface treatment. For instance, for certain portions e.g. the furthest extremities of a blind hole, very rapid depletion of the plasma constituents occurs, the insufficient degree of ionic bombardment consequently resulting in an extremely uneven surface treatment which, more importantly, may be inadequate.

STATEMENT OF THE INVENTION

In accordance with the present invention, a method of thermochemical treatment of a workpiece in a gas comprises repeated steps of ionic bombardment to provide a desired surface treatment, wherein the duration of the steps and the intervals between them are selected to allow, during the treatment, a substantially even distribution of the gas over all the surface to be treated of the workpiece.

Consequently, arranging for ionic bombardment to occur in discrete steps, separated by selected time intervals, allows a uniform treatment of the surface, entirely obviating the problems associated with plasma depletion. Clearly, however, the duration of the steps of ionic bombardment should not be selected to be so long that significantly undesirable plasma depletion occurs over the duration of any given step.

According to another aspect of the invention, during each of said steps, the gas comprises a plasma generated by a high voltage discharge. Further, the mechanism of distribution of gas during the intervals between successive steps may be by diffusion.

According to a further aspect of the invention, an apparatus for thermochemical treatment of a workpiece comprises means for heating the workpiece to a predetermined temperature; means providing a gas about the workpiece; and means to induce repeated steps of ionic bombardment to provide a desired surface treatment and wherein said means to induce is arranged to provide said steps and intervals between them selected to allow, during the treatment, a substantially even distribution of the gas over all the surface to be treated of the workpiece.

The use of a series of plasma pulses has further advantages compared to a continuous plasma arrangement. For instance, the energy input is reduced and the temperature uniformity when a number of workpieces are being treated is increased.

Further, the possibility of undesirable arc or hollow cathode formation is also reduced since localised phenomenom which are associated with such processes, such as an increase in pressure, have insufficient time to develop during any one plasma pulse. Consequently, higher currents can be used to achieve increased reaction rates and uniformity whilst maintaining a reduced susceptibility to arc or hollow cathode formation.

BRIEF DESCRIPTION OF THE DRAWING

An example of the invention will now be described with reference to the accompanying drawing which depicts a schematic diagram of an apparatus for thermochemical treatment.

DETAILED DESCRIPTION

Referring now to the drawing, a gas tight vessel or furnace 1 is shown enclosing an electrical heating means 2, having power supply lines 3, for heating the workpiece (not shown) to a predetermined temperature. Means for providing a gas about the workpiece comprises a gas feed line 9, including a gas valve 10, connected to the gas tight vessel 1. While separate anode electrodes may be located inside the vessel 1, and electrodes connected to it, in the present embodiment the vessel acts as the anode electrode. HV pulses are applied between the anode and cathode electrodes to induce ionic bombardment of the workpiece (not shown) by constituents of the gas supplied on feedline 9 to effect thermochemical treatment. A worktable 5 and the workpiece (not shown) to be treated together comprise the cathode, the workpiece being placed on the worktable 5 and the worktable 5 being supported in the vessel by electrically insulating supports 11. One set of power supply lines 6 is connected to the worktable 5 comprising the cathode whereas another set of power supply lines 4 is connected to the vessel 1. A high voltage power unit 7 is connected to both sets of power supply lines 4 and 6 and has connections 8 to an external power source (not shown). The high voltage power unit 7 is adapted to supply high voltage pulses to induce repeated steps of ionic bombardment, the steps and the intervals between them being selected to allow, during thermochemical treatment of the workpiece (not shown) to be treated, a substantially even distribution of the gas over all the surface to be treated of the workpiece (not shown).

In use for carburising a workpiece, an atmosphere of approximately 95% hydrogen and 5% methane at a pressure from 300–1000 Pa together with a workpiece temperature of approximately 900° C. is suitable. For cylindrical holes 2 mm in diameter and 20 mm in length it takes, for a diffusion dominated regime, approximately 10 ms to establish an even distribution of methane around the workpiece, including to the end of the hole, from vacuum conditions. Consequently, the time interval between successive steps of ionic bombardment is 10 ms. Ionic bombardment is induced by the application of a high voltage D.C. discharge which generates a plasma of carbon and hydrocarbon ions around the workpiece. Consequently, the interval between successive discharges is itself approximately 10 ms. The duration of time over which the discharge has to be maintained is also determined, amongst other things, by the transport properties of the plasma over the workpiece surface: ionic bombardment, induced by high voltage discharges of approximately 5 as duration have been found to be appropriate.

It will be appreciated that the appropriate time periods, in particular for the interval between successive steps of ionic bombardment, can generally be readily determined once the geometry of the workpiece, the composition, concentration, temperature and pressure of the gaseous atmosphere and the dominant transport regime are known.

We claim:

1. A method of thermochemical treatment of a workpiece having first surface portions less accessible for treatment than other portions in a gas comprising the steps of bombarding a workpiece with ions for a series of time periods to provide a desired surface treatment to the workpiece, separating the steps of active bombardment by an interval of substantially no active ionic bombardment, the duration of the steps and the intervals between them being timed to provide a substantially even distribution of the gas over all the surface portions to be treated of the workpiece.

2. A method of thermochemical treatment as claimed in claim 1 wherein, during each of said steps, the gas comprises a plasma generated by a high voltage discharge.

3. A method of thermochemical treatment as claimed in claim 1 and the step of permitting the gas to be distributed during the intervals by diffusion.

4. A method of thermochemical treatment as claimed in claim 3 wherein the duration of each step is at least 5 milliseconds and the duration of the interval between succesive steps is at least 10 milliseconds.

5. An apparatus for thermochemical treatment of a workpiece comprising means for heating the workpiece to a predetermined temperature; means providing a gas about the workpiece; and means operable to induce repeated time separated periods of ionic bombardment to provide a desired surface treatment and said means to induce including means to provide intervals of substantially no ionic bombardment between the periods of ionic bombardment to allow, during the treatment, a substantially even distribution of the gas over all the surface to be treated of the workpiece.

6. An apparatus as claimed in claim 5 wherein the means operable to induce ionic bombardment comprises a high voltage discharge means for generating a plasma around the workpiece.

7. An apparatus as claimed in claim 5 wherein the last mentioned means provides intervals of time of no ionic bombardment between the periods of ionic bombardment that is substantially twice as long as the periods of ionic bombardment.

8. An apparatus as specified in claim 5 in which the thermochemical treatment is carburizing, and the temperature of the workpiece is maintained in the range of 900° C.

* * * * *